US007575645B2

(12) United States Patent
Igarashi et al.

(10) Patent No.: US 7,575,645 B2
(45) Date of Patent: Aug. 18, 2009

(54) FE-NI-MO SOFT MAGNETIC FLAKY POWDER AND MAGNETIC COMPOSITE MATERIAL CONTAINING SOFT MAGNETIC POWDER

(75) Inventors: Kazunori Igarashi, Niigata (JP); Gakuji Uozumi, Naka (JP); Yasushi Nayuki, Choshi (JP); Ryoji Nakayama, Naka (JP)

(73) Assignees: Mitsubishi Materials Corporation, Tokyo (JP); JEMCO Inc., Akita-Ken (JP)

( * ) Notice: Subject to any disclaimer, the term of this patent is extended or adjusted under 35 U.S.C. 154(b) by 353 days.

(21) Appl. No.: 10/567,476

(22) PCT Filed: Aug. 4, 2004

(86) PCT No.: PCT/JP2004/011514

§ 371 (c)(1),
(2), (4) Date: Jul. 18, 2006

(87) PCT Pub. No.: WO2005/011899

PCT Pub. Date: Feb. 10, 2005

(65) Prior Publication Data

US 2007/0131311 A1 Jun. 14, 2007

(30) Foreign Application Priority Data

| | | |
|---|---|---|
| Aug. 5, 2003 | (JP) | 2003-205956 |
| Oct. 20, 2003 | (JP) | 2003-358970 |
| Feb. 18, 2004 | (JP) | 2004-041029 |
| Jul. 26, 2004 | (JP) | 2004-217371 |

(51) Int. Cl.
*H01F 1/147* (2006.01)

(52) U.S. Cl. ..... 148/312; 428/402; 428/403

(58) Field of Classification Search ..... None
See application file for complete search history.

(56) References Cited

U.S. PATENT DOCUMENTS

| | | | | |
|---|---|---|---|---|
| 4,923,533 | A * | 5/1990 | Shigeta et al. | 148/304 |
| 2005/0012652 | A1 * | 1/2005 | Wakayama et al. | 342/1 |

FOREIGN PATENT DOCUMENTS

| | | | |
|---|---|---|---|
| JP | 2-39599 | A | 2/1990 |
| JP | 3-223401 | A | 10/1991 |
| JP | 3-232574 | A | 10/1991 |
| JP | 4-48003 | A | 2/1992 |
| JP | 4-78112 | A | 3/1992 |
| JP | 2003-49203 | A | 2/2003 |

OTHER PUBLICATIONS

International Search Report for PCT/JP2004/011514 mailed Nov. 22, 2004.

* cited by examiner

*Primary Examiner*—John P. Sheehan
(74) *Attorney, Agent, or Firm*—Darby & Darby P.C.

(57) ABSTRACT

The invention provides an Fe—Ni—Mo soft magnetic flaky powder having a component composition of, in percent by mass, Ni: 60 to 90%, Mo: 0.05 to 1.95%, and the balance of Fe and unavoidable impurities, and a flat surface of an average particle size of 30 to 150 μm, and an aspect ratio (average particle size /average thickness) of 5 to 500; and having a peak intensity ratio $I_{200}/I_{111}$ within a range between 0.43 and 10, where $I_{200}$ is the peak height of the face index (200) and $I_{111}$ is the peak height of the face index (111), in an X-ray diffraction pattern measured in such a manner that the plane including the X-ray incident direction and the diffraction direction is perpendicular to the flat surface of the soft magnetic flaky powder, and the angle between the incident direction and the flat surface is equal to the angle between the diffraction direction and the flat surface. Furthermore, the invention provides a soft magnetic flaky powder with oxide layer wherein an oxide layer of a thickness of 50 to 1000 Å is formed on the surface of this soft magnetic flaky powder.

6 Claims, 1 Drawing Sheet

FE-NI-MO SOFT MAGNETIC FLAKY POWDER AND MAGNETIC COMPOSITE MATERIAL CONTAINING SOFT MAGNETIC POWDER

CROSS-REFERENCE TO RELATED APPLICATIONS

This is a U.S. National Phase Application under 35 U.S.C. §371 of International Patent Application No. PCT/JP2004/011514 filed Aug. 4, 2004, and claims the benefit of Japanese Patent Application Nos. 2003-205956 filed Aug. 5, 2003, 2003-358970 filed Oct. 20, 2003, 2004-041029 filed Feb. 18, 2004 and 2004-217371 filed Jul. 26, 2004, all of which are incorporated by reference herein. The International Application was pulished in Japanese on Feb. 10, 2005 as WO 2005/011899 A1 under PCT Article 21(2).

TECHNICAL FIELD

The present invention relates to an Fe—Ni—Mo soft magnetic flaky powder used for a high frequency magnetic material such as a radio wave absorber having a superior radio wave absorption property at several tens MHz to several GHz, and an antenna core for wireless communications having a superior magnetic property at several tens kHz to several tens MHz. Moreover, the present invention relates to a magnetic composite material wherein the Fe—Ni—Mo soft magnetic flaky powder is oriented and dispersed in a resin.

BACKGROUND ART

In general, a permalloy A (Fe-70 to 80% Ni) (% denotes percent by mass, which is the same hereinunder) is known, as a high permeability soft magnetic material as an ingot material and a sintered material. After applying heat treatment to this material, if it is annealed, an $FeNi_3$ order phase is generated and the crystalline magnetic anisotropy constant $K_1$ becomes negative with a large absolute value. It is known that: if the crystalline magnetic anisotropy constant $K_1$ is negative, the <111> direction becomes the easy magnetization direction and the <100> direction becomes the hard magnetization direction; if it is positive, the <100> direction becomes the easy magnetization direction and the <111> direction becomes the hard magnetization direction; and if it is zero, the crystalline material becomes magnetically isotropic. Due to the generation of this $FeNi_3$ order phase, magnetic anisotropy is generated, resulting in a decrease in the magnetic permeability in a normal polycrystalline substance where the crystal face is not oriented, and which is isotropic in the crystal orientation. To obtain a high magnetic permeability in this material requires quenching after high temperature heat treatment, and further an aging treatment thereafter. However, such processing is not industrially used.

Moreover, there is known a Mo permalloy (Fe-79% Ni-4%-Mo) and a supermalloy (Fe-79% Ni-5% Mo), that are permalloys added with Mo. Due to the addition of Mo, even if these materials are annealed after heat treatment, generation of the $FeNi_3$ order phase is suppressed, and even if quenching is not applied after heat treatment, the crystalline magnetic anisotropy constant $K_1$ becomes about zero, showing a superior magnetic permeability in a polycrystalline substance which is isotropic on the crystal orientation. Therefore, these materials are widely used industrially. Moreover, in order to further improve the magnetic permeability, a high permeability soft magnetic material added with Cu, Cr, and Mn in addition to Mo is known.

Meanwhile, there is known that a soft magnetic flaky powder is obtained by flattening powder having a similar composition. For example, a soft magnetic flaky powder is known, which has the composition of Fe-70 to 83% Ni-2 to 6% Mo-3 to 6% Cu-1 to 2% Mn, an average particle size of 0.1 to 30 μm, and an average thickness of 2 μm or less. The soft magnetic flaky powder is used, for example, as a soft magnetic flaky powder for a magnetic card (refer to Japanese Unexamined Patent Application, First Application No. Hei 03-223401).

Moreover, there is known soft magnetic flaky powder having a composition of Fe-40 to 80% Ni-2 to 6% Mo. This soft magnetic flaky powder is used, for example, as a flat soft magnetic powder for magnetic marking (refer to Japanese Unexamined Patent Application, First Application No. Hei 03-232574).

Furthermore, a soft magnetic flaky powder is known, which has a composition of Fe-60 to 80% Ni—Mo or Fe-60 to 80% Ni-5% or less Mo. This soft magnetic flaky powder is used, for example, as a high frequency magnetic core (refer to Japanese Unexamined Patent Application, First Application No. Hei 04-78112).

In any of such conventional Fe—Ni—Mo soft magnetic flaky powders, it is known that the magnetic property such as the magnetic permeability in the flat surface of the powder can be further increased by flattening the Fe—Ni—Mo powder obtained by normal crushing or atomization for generating shape magnetic anisotropy due to the demagnetizing field, so as to make the easy magnetization face be within the flat surface.

Such conventional Fe—Ni—Mo soft magnetic flaky powders are all manufactured such that the Fe—Ni—Mo powder obtained by normal crushing or atomization is added with ethanol or water as a solvent, and further added with pulverizing agent as required, which is then flattened using an attritor or a ball mill.

The thus obtained Fe—Ni—Mo soft magnetic flaky powder is used to form a magnetic composite material by dispersing the flat soft magnetic powder in the resin such that the flat face is oriented in one direction. In a case that the magnetic composite material is a magnetic composite sheet, the flat surface of the Fe—Ni—Mo soft magnetic flaky powder is oriented in the right angle direction with respect to the thickness direction of the magnetic composite sheet.

However, there is a problem that the conventional Fe—Ni—Mo soft magnetic flaky powder does not exhibit sufficient properties as a high frequency magnetic material for use as a radio wave absorber having a radio wave absorption property at several tens MHz to several GHz, or for use as an antenna core for wireless communications having the magnetic property at several tens kHz to several tens MHz. Therefore, it is desired to obtain a soft magnetic flaky powder having more superior magnetic permeability in the flat surface.

DISCLOSURE OF INVENTION

The present inventors have carried out research to obtain an Fe—Ni—Mo soft magnetic flaky powder having more superior properties as a radio wave absorber or a high frequency magnetic material, than a conventional Fe—Ni—Mo soft magnetic flaky powder, resulting the following findings.

(a) If an Fe—Ni—Mo metal soft magnetic powder having a component composition of, Ni: 60 to 90%, Mo: 0.05 to 1.95%, and the balance of Fe and unavoidable impurities, is flattened using an attritor or a ball mill together with a solvent having a higher viscosity, the impact applied on the powder is reduced and the crushing effect progressing simultaneously with the flattening is repressed, and as a result a thin and large Fe—Ni—Mo soft magnetic flaky powder is obtained. Moreover, regarding the Fe—Ni—Mo soft magnetic flaky powder obtained in this manner, the peak intensity ratio $I_{200}/I_{111}$ is within a range between 0.43 and 10, where $I_{200}$ is the peak height of the face index (200) and $I_{111}$ is the peak height of the face index (111) in an X-ray diffraction pattern measured in such a manner that the plane including the X-ray incident direction and the diffraction direction is perpendicular to the flat surface of the soft magnetic flaky powder, and the angle between the incident direction and the flat surface is equal to the angle between the diffraction direction and the flat surface. Moreover, since the Fe—Ni—Mo soft magnetic flaky powder having the peak intensity ratio $I_{200}/I_{111}$ within the range between 0.43 and 10 shows a high value in the imaginary part of the complex magnetic permeability at several tens MHz to several GHz, showing a superior property as a powder for a radio wave absorber having a radio wave absorption property in this frequency band. Moreover, it shows a high value in the real number of the complex magnetic permeability at several tens kHz to several tens Mar, showing a superior property as a high frequency magnetic material such as an antenna core for wireless communications having a soft magnetic property in this frequency band.

(b) In this Fe—Ni—Mo soft magnetic flaky powder, by stipulating the average particle size to be from 30 to 150 μm, and the aspect ratio (average particle size/average thickness) to be from 5 to 500, the magnetic permeability in the flat surface is further improved.

The present invention is invented based on these findings, wherein (1) A soft magnetic flaky powder having a component composition of, Ni: 60 to 90%, Mo: 0.05 to 1.95%, and the balance of Fe and unavoidable impurities, and the dimension and the shape of an average particle size of 30 to 150 μm, and an aspect ratio of 5 to 500; and having a peak intensity ratio $I_{200}/I_{111}$ in the range between 0.43 and 10, where $I_{200}$ is the peak height of the face index (200) and $I_{111}$ is the peak height of the face index (111), in an X-ray diffraction pattern measured in such a manner that the plane including the X-ray incident direction and the diffraction direction is perpendicular to the flat surface of the soft magnetic flaky powder, and the angle between the incident direction and the flat surface is equal to the angle between the diffraction direction and the flat surface.

The Fe—Ni—Mo soft magnetic flaky powder of the present invention is dispersed so as to orient the flat surface mainly within a resin, and is used as a magnetic composite material, in particular a magnetic composite sheet. In the case of the magnetic composite sheet, the flat surface of the Fe—Ni—Mo soft magnetic flaky powder is oriented in the right angle direction with respect to the thickness direction of the magnetic composite sheet. Therefore, the present invention is characterized in (2) a magnetic composite material wherein the Fe—Ni—Mo soft magnetic flaky powder described in (1) is dispersed while the flat surface thereof is oriented in a resin, (3) a magnetic composite sheet wherein the magnetic composite material described in (2) is a magnetic composite sheet, and the flat surface of the Fe—Ni—Mo soft magnetic flaky powder is oriented in the right angle direction with respect to the thickness direction of the magnetic composite sheet.

The magnetic composite material described in (2) and the magnetic composite sheet described in (3) wherein the Fe—Ni—Mo soft magnetic flaky powder described in (1) is dispersed so as to orient the flat surface, within a resin, have a superior property as a high frequency magnetic material such as a radio wave absorber and an antenna core for wireless communications. However, since the Fe—Ni—Mo soft magnetic flaky powder has a component composition where it is difficult to generate an oxide layer on the surface, then even if this Fe—Ni—Mo soft magnetic flaky powder is left for a long time in the air, the thickness of an oxide layer formed on the surface of the Fe—Ni—Mo soft magnetic flaky powder is less than 50 Å, and if the Fe—Ni—Mo soft magnetic flaky powder having this thin oxide layer is dispersed in a resin at high density, the Fe—Ni—Mo soft magnetic flaky powders become adjacent to each other. As a result, as the dispersion amount of the Fe—Ni—Mo soft magnetic flaky powder becomes a higher density, the specific resistance of the obtained magnetic composite material or magnetic composite sheet is decreased.

Therefore, in some cases, the specific resistance as a magnetic composite material or a magnetic composite sheet becomes insufficient, requiring a magnetic composite material or a magnetic composite sheet having a higher specific resistance. In order to fulfill this requirement, it becomes necessary to form a thicker oxide layer (50 to 1000 Å) on the surface of the Fe—Ni—Mo soft magnetic flaky powder described in (1). This thicker oxide layer can be produced by heating the Fe—Ni—Mo soft magnetic flaky powder described in (1) in an oxidizing atmosphere, or heating in warm water and then drying. Therefore, the present invention is characterized in (4) an Fe—Ni—Mo soft magnetic fluky powder with oxide layer wherein an oxide layer of a thickness of 50 to 1000 Å is formed on the surface of a soft magnetic flaky powder having a component composition of, Ni: 60 to 90%, Mo: 0.05 to 1.95%, and the balance of Fe and unavoidable impurities, and a flat surface of an average particle size of 30 to 150 μm, and an aspect ratio (average particle size/average thickness) of 5 to 500; and wherein a peak intensity ratio $I_{200}/I_{111}$ is within a range between 0.43 and 10, where $I_{200}$ is the peak height of the face index (200) and $I_{111}$ is the peak height of the face index (111), in an X-ray diffraction pattern measured in such a manner that the plane including the X-ray incident direction and the diffraction direction is perpendicular to the flat surface of the soft magnetic flaky powder with oxide layer, and the angle between the incident direction and the flat surface is equal to the angle between the diffraction direction and the flat surface.

(5) a magnetic composite material wherein the Fe—Ni—Mo soft magnetic flaky powder with oxide layer described in (4) is dispersed while the flat surface thereof is oriented in a resin, (6) a magnetic composite sheet wherein the magnetic composite material described in (5) is a magnetic composite sheet, and the flat surface of the Fe—Ni—Mo soft magnetic flaky powder with oxide layer is oriented in the right angle direction with respect to the thickness direction of the magnetic composite sheet.

In order to manufacture the Fe—Ni—Mo soft magnetic flaky powder with oxide layer described in (4), the Fe—Ni—Mo soft magnetic flaky powder described in (1) may be heated in an oxidizing atmosphere such as an air or a mixed gas atmosphere containing oxygen, under a condition of a temperature of 300 to 600° C. held for 1 minute to 24 hours. Alternatively, it may be heated in warm water at 50 to 100° C. for 1 minute to 96 hours, and thereafter dried at 50 to 200° C.

If the thickness of the oxide layer on the Fe—Ni—Mo soft magnetic flaky powder with oxide layer described in (4) of the present invention is less than 50 Å, the specific resistance becomes insufficient as a magnetic composite sheet, and hence this is undesirable. If it is more than 1000 Å, the coercive force is increased, decreasing the radio wave absorption property as a magnetic composite sheet, and hence this is undesirable. Therefore, the thickness of the oxide layer is designed to have the lower limit of 50 Å and the upper limit of 1000 Å.

Moreover, the resin used for the magnetic composite material and the magnetic composite sheet of the present invention is chlorinated polyethylene, silicone, urethane, vinyl acetate, ethylene-vinyl acetate copolymer, ABS resin, vinyl chloride, polyvinyl butyral, thermoplastic elastomer, EM-PM-BD copolymerized rubber, styrene butadiene rubber, acrylonitrile-butadiene rubber, and the like. Furthermore, it may be a blend thereof or a modified blend thereof.

Since the Fe—Ni—Mo soft magnetic flaky powder and the Fe—Ni—Mo soft magnetic flaky powder with oxide layer of the present invention has a large maximum value in the real number of the complex magnetic permeability for 30 kHz to 30 MHz, a superior high frequency magnetic material as an antenna or an inductor can be provided. Furthermore, since the maximum value in the imaginary part of the complex magnetic permeability for 30 MHz to 3 GHz is large, a radio wave absorber having a superior radio wave absorption property can be provided. As a result, excellent effects are provided for the electrical and electronic industries.

Hereunder is a description of the reason why the component composition, the average particle size, the aspect ratio, and the peak intensity ratio are restricted as mentioned above, in the Fe—Ni—Mo soft magnetic flaky powder and the Fe—Ni—Mo soft magnetic flaky powder with oxide layer of the present invention.

Component Composition:

The reason why the Ni content in the Fe—Ni—Mo soft magnetic flaky powder and the Fe—Ni—Mo soft magnetic flaky powder with oxide layer of the present invention is restricted to 60 to 90% is that the magnetic property is decreased if it is less than 60% or more than 90%. Tis range is a commonly known range, however preferably the Ni content in the Fe—Ni—Mo soft magnetic flaky powder and the Fe—Ni—Mo soft magnetic flaky powder with oxide layer of the present invention is within a range between 70 and 85%.

Moreover, the reason why the Mo addition is restricted to 0.05 to 1.95% is that if the Mo is less than 0.05%, the generation of the $FeNi_3$ order phase becomes excessive due to the annealing after the heat treatment, and the crystalline magnetic anisotropy constant $K_1$ is negative so that the absolute value becomes too large, decreasing the magnetic property, and hence this is undesirable, while if it contains more than 1.95%, the generation of the $FeNi_3$ order phase becomes insufficient, and the crystalline magnetic anisotropy constant $K_1$ is negative so that the absolute value becomes too small, or becomes positive, so that the effect of further making the easy face of magnetization in the flat surface by means of the crystalline magnetic anisotropy becomes insufficient, decreasing the magnetic permeability in the flat surface, and hence this is undesirable. In the Fe—Ni—Mo soft magnetic flaky powder and the Fe—Ni—Mo soft magnetic flaky powder with oxide layer of the present invention, a more preferable range for the Mo content is between 0.5 and 1.95% (more preferably, 0.8 and 1.9%).

Average Particle Size:

In the Fe—Ni—Mo soft magnetic flaky powder and the Fe—Ni—Mo soft Magnetic flaky powder with oxide layer of the present invention, if the average particle size is less than 30 μm, the introduction of distortion at the time of flattening processing becomes remarkable, and a sufficient magnetic property can not be obtained even if heat treatment at a temperature of 500° C. or more is applied, and hence this is undesirable. On the other hand, if the average particle size exceeds 150 μm, then in the kneading with a resin and the like when a sheet and the like is produced, the powder is bent or broken, decreasing the magnetic property, and hence this is undesirable. Consequently, the average particle size of the soft magnetic flaky powder and the Fe—Ni—Mo soft magnetic flaky powder with oxide layer of the present invention is restricted to 30 to 150 μm. A more preferable range of the average particle size is between 35 to 140 μm.

Aspect Ratio:

In the Fe—Ni—Mo soft magnetic flaky powder and the Fe—Ni—Mo soft magnetic flaky powder with oxide layer of the present invention, if the aspect ratio is less than 5, the diamagnetic field of the powder becomes greater, decreasing the magnetic permeability in the flat surface, and hence this is undesirable. On the other hand, if the aspect ratio is more than 500, the introduction of distortion at the time of flattening processing becomes remarkable, and a sufficient magnetic property can not be obtained even if heat treatment at a temperature of 500° C. or more is applied, and hence this is undesirable. Consequently, the aspect ratio of the Fe—Ni—Mo soft magnetic flaky powder and the Fe—Ni—Mo soft magnetic flaky powder with oxide layer of the present invention is restricted to 5 to 500.

Peak Intensity Ratio:

If the Fe—Ni—Mo metal soft magnetic powder is flattened using an attritor or a ball mill together with a solvent having a higher viscosity, the (100) face of the face-centered cubic (fcc) lattice is oriented in parallel with the flat surface of the powder. However, in the X-ray diffraction pattern measured in such a manner that the plane including the X-ray incident direction and the diffraction direction is perpendicular to the flat surface of the soft magnetic flaky powder, and the angle between the incident direction and the flat surface is equal to the angle between the diffraction direction and the flat surface, regarding the peak of the face index (100), according to the extinction rule for the diffraction peak of the face-centered cubic (fcc) lattice, only a small peak can be observed due to the generation of the $FeNi_3$ order phase. Moreover the peak height is affected by the generated amount of the $FeNi_3$ order phase. Therefore, in the present invention, as an index of how the (100) face of the fcc lattice is oriented in parallel with the flat surface of the powder, the peak height $I_{200}$ of the face index (200) which is the secondary diffraction peak due to the (100) face and is not affected by the generation of the $FeNi_3$ order phase, is measured, and the peak intensity ratio $I_{200}/I_{111}$ is obtained with respect to the peak height $I_{111}$ of the face index (111) which shows the maximum peak in the case where the crystal orientation is not oriented. In the Fe—Ni—Mo soft magnetic flaky powder of the present invention, the reason why the $I_{200}/I_{111}$ is set so as to be within the range between 0.43 and 10 is that if it is less than 0.43 the effect of further making the easy face of magnetization in the flat surface by means of the crystalline magnetic anisotropy becomes insufficient, decreasing the magnetic permeability in the flat surface, and hence this is undesirable, and a powder where this is more than 10 is difficult to manufacture. A more preferable range of the peak intensity is between 0.50 and 10, and an even more preferable range is between 0.60 and 10.

Moreover, the viscosity coefficient of the solvent having a higher viscosity that is used when manufacturing the Fe—Ni—Mo soft magnetic flaky powder and the Fe—Ni—Mo soft magnetic flaky powder with oxide layer of the present invention, is preferably within a range between 2 and 5 mPas [millipascal second]. If the viscosity coefficient of the solvent added at the time of the flattening processing by means of an attritor or a ball mill is less than 2 mPas, the effect of reducing the impact applied to the soft magnetic powder serving as a raw material powder is low, causing crushing at the time of the flattening processing, by which the thin and large powder can not be obtained. Moreover the effect of orienting the (100) face in parallel with the flat surface of the powder, becomes insufficient resulting in a decrease in the magnetic permeability of the powder. Hence this is undesirable. On the other hand, if the viscosity coefficient of the solvent is more than 5 mPas, the efficiency of the flattening processing is remarkably decreased, and the valve at the outlet becomes clogged when the slurry, a mixture of the powder and the solvent, is taken out after the flattening processing. Furthermore the slurry circulation unit that is installed in order to improve the uniformity of the flattening processing, becomes clogged. Hence this is undesirable.

As this solvent having a higher viscosity, there may be employed a higher alcohol which is liquid at room temperature such as; isobutyl alcohol (viscosity coefficient at 20° C.: 4.4 mPas [millipascal second], (the same abbreviation and conditions apply hereunder), where 1 mPas=1 cP [centipoise]), isopentyl alcohol (4.4 mPas), 1-butanol (3.0 mPas), 1-propanol (2.2 mPas), and 2-propanol (2.4 mPas). Moreover, this may be a higher alcohol, ethylene glycol, glycerin, and the like which are liquid or solid at room temperature, dissolved in water, ethanol, or methanol. These higher alcohols, ethylene glycol, glycerin, and the like which are liquid or solid at room temperature, dissolved in water, ethanol, or methanol, show a higher viscosity coefficient compared to conventionally used water (1.0 mPas), ethanol, (1.2 mPas), and methanol (0.6 mPas).

BEST MODE FOR CARRYING OUT THE INVENTION

Figure 1:
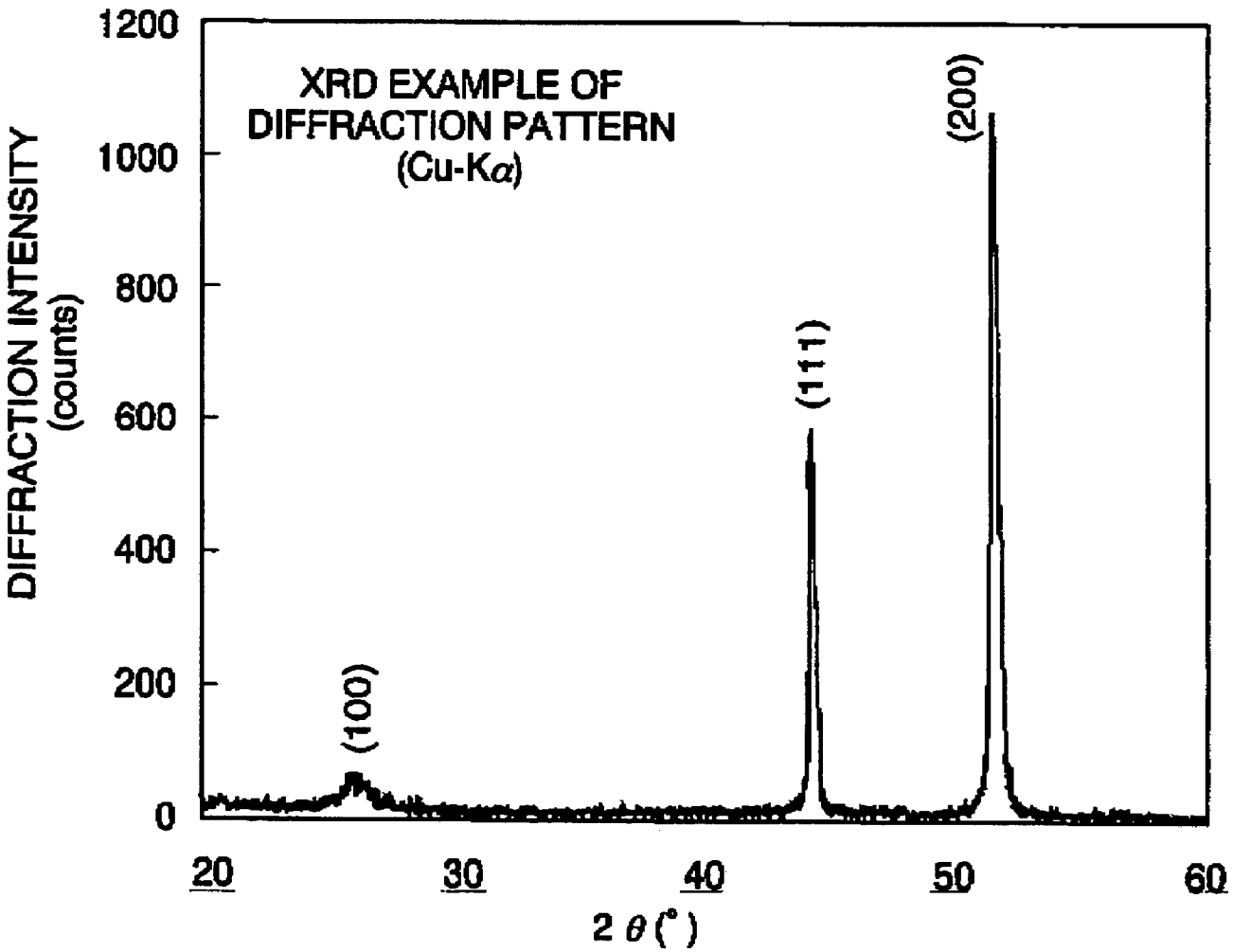
FIG. 1 is an X-ray diffraction pattern of Cu-Kα of a soft magnetic flaky powder 3 of the present invention.

Hereunder is a description of preferred examples of the present invention. However, the present invention is not limited to the respective examples hereunder, and for example components in these examples may be appropriately combined.

EXAMPLE 1

The alloy raw materials were high frequency melted to produce molten metals of the component composition shown in Tables 1 and 2. These molten metals mere water-atomized to produce atomized powders. The atomized powders were classified to produce atomized raw material powders. Furthermore, as a solvent, there was prepared a solvent being ethanol to which was added glycerin at 35 percent by mass (viscosity coefficient at 20° C.: 3.1 mPas).

The atomized raw material powder was added with the solvent containing glycerin of 35 percent by mass in ethanol, and was then subjected to flattening processing by an attritor. Next, it was put into a heat treating furnace to perform heat treatment in an Ar gas atmosphere at a temperature of 500° C. and held for 2 hours. These heat treated powders were classified by a pneumatic classifier, to produce the soft magnetic flaky powders 1 to 20 of the present invention and the comparative soft magnetic flaky powders 1 to 8 having the component composition, the average particle size d, the average thickness t, and the aspect ratio (d/t) shown in Tables 1 and 2.

Furthermore, as a solvent, ethanol (viscosity coefficient at 20° C.: 1.2 mPas) was prepared. The atomized raw material powder was added with the ethanol, and was then subjected to flattening processing by an attritor. Next, it was put into a heat treating furnace to perform the heat treatment in an Ar gas atmosphere at a temperature of 500° C. and held for 2 hours. These heat treated powders were classified by a pneumatic classifier, to produce the comparative soft magnetic flaky powders (equivalent to conventional products) having the component composition, the average particle size d, the average thickness t, and the aspect ratio (d/t) shown in Table 2.

The soft magnetic flaky powders 1 to 20 of the present invention, the comparative soft magnetic flaky powders 1 to 8, and the conventional soft magnetic flaky powder obtained in this manner were mixed with chlorinated polyethylene at 15 percent by mass, then roll-formed, to thereby produce a magnetic composite sheet having a thickness of 0.5 mm in which the flat surface of the soft magnetic flaky powder was arranged in parallel with the sheet face. The X-ray diffraction pattern of Cu-Kα was obtained by measuring with the plane including the X-ray incident direction and the diffraction direction perpendicular to the sheet face of the magnetic composite sheet, and the angle between the incident direction and the sheet face equal to the angle between the diffraction direction and the sheet face. The peak intensity ratio $I_{200}/I_{111}$ was then calculated. The results are shown in Table 1 and Table 2.

For reference, the X-ray diffraction pattern of Cu-Kα of the soft magnetic flaky powder 3 of the present invention is shown in FIG. 1. As is apparent from FIG. 1, in the Fe—Ni—Mo soft magnetic flaky powder obtained by flattening the Fe—Ni—Mo metal soft magnetic powder using an attritor or a ball mill together with a solvent having a higher viscosity, the (100) face of the face-centered cubic (fcc) lattice is oriented in parallel with the flat surface of the powder. However, regarding the peak of the face index (100), according to the extinction rule for the diffraction peak of the face-centered cubic (fcc) lattice, almost no peak appeared in the X-ray diffraction pattern and only a small peak could be observed due to the generation of the $FeNi_3$ order phase. Moreover the peak height is affected by the generated amount of the $FeNi_3$ order phase. Here, in the present example, the peak height $I_{200}$ of the face index (200) which is the secondary diffraction peak due to the (100) face and is not affected by the generation of the $FeNi_3$ order phase, was measured, and the peak intensity ratio $I_{200}/I_{111}$ was obtained with respect to the peak height $I_{111}$ of the face index (111) which showed the maximum peak in the case where the crystal orientation is not oriented.

Furthermore, samples were prepared by cutting out from these magnetic composite sheets, and the complex magnetic permeability for 30 kHz to 30 MHz and for 30 MHz to 3 GHz was measured by an impedance analyzer and a network analyzer. The maximum value in the real number of the complex magnetic permeability for 30 kHz to 30 MHz which is important for an antenna and an inductor, and the maximum value in the imaginary part of the complex magnetic permeability for 30 MHz to 3 GHz which is important for a radio wave absorber, were measured. The results are shown in Table 1 and Table 2.

TABLE 1

| Soft magnetic flaky powder | | Component composition (percent by mass) Ni | Mo | Fe | Average particle size d (μm) | Average thickness t (μm) | Aspect ratio d/t | $I_{200}/I_{111}$ | Maximum value in real number of complex magnetic permeability for 30 kHz-30 MHz | Maximum value in imaginary part of complex magnetic permeability for 30 MHz-3 GHz |
|---|---|---|---|---|---|---|---|---|---|---|
| Present invention | 1 | 60.7 | 1.52 | balance | 61.9 | 0.3 | 206 | 0.44 | 69 | 20 |
| | 2 | 65.2 | 0.61 | balance | 43.3 | 1.7 | 25 | 1.97 | 68 | 20 |
| | 3 | 70.1 | 1.16 | balance | 31.1 | 0.9 | 35 | 1.77 | 76 | 24 |
| | 4 | 74.8 | 0.77 | balance | 56.4 | 3.7 | 15 | 4.22 | 66 | 20 |
| | 5 | 75.0 | 1.63 | balance | 41.9 | 2.0 | 21 | 9.62 | 72 | 22 |
| | 6 | 77.9 | 0.08 | balance | 35.6 | 4.4 | 8.1 | 2.42 | 64 | 20 |
| | 7 | 78.1 | 1.39 | balance | 69.8 | 0.6 | 116 | 0.57 | 74 | 23 |
| | 8 | 78.1 | 1.95 | Balance | 47.2 | 2.7 | 17 | 6.26 | 67 | 20 |
| | 9 | 80.0 | 0.94 | balance | 58.7 | 0.2 | 294 | 0.73 | 81 | 25 |
| | 10 | 80.2 | 1.43 | balance | 64.6 | 1.4 | 46 | 2.79 | 74 | 23 |
| | 11 | 79.9 | 1.74 | balance | 32.3 | 0.9 | 36 | 1.43 | 65 | 20 |
| | 12 | 81.8 | 0.43 | balance | 48.8 | 0.1 | 488 | 0.66 | 62 | 19 |
| | 13 | 82.1 | 1.38 | balance | 51.2 | 1.1 | 47 | 3.66 | 71 | 22 |
| | 14 | 82.2 | 1.83 | balance | 66.5 | 0.2 | 333 | 0.98 | 80 | 24 |
| | 15 | 85.0 | 0.95 | balance | 34.3 | 0.6 | 57 | 1.24 | 77 | 23 |

TABLE 2

| Soft magnetic flaky powder | | Component composition (percent by mass) Ni | Mo | Fe | Average particle size d (μm) | Average thickness t (μm) | Aspect ratio d/t | $I_{200}/I_{111}$ | Maximum value in real number of complex magnetic permeability for 30 kHz-30 MHz | Maximum value in imaginary part of complex magnetic permeability for 30 MHz-3 GHz |
|---|---|---|---|---|---|---|---|---|---|---|
| Present invention | 16 | 84.9 | 1.72 | balance | 40.5 | 7.1 | 5.7 | 1.83 | 73 | 22 |
| | 17 | 89.9 | 1.12 | balance | 37.6 | 1.7 | 22 | 0.85 | 65 | 20 |
| | 18 | 80.5 | 1.06 | balance | 78.4 | 4.3 | 18 | 0.78 | 78 | 24 |
| | 19 | 79.7 | 1.95 | balance | 88.7 | 3.6 | 25 | 1.15 | 75 | 22 |
| | 20 | 80.2 | 1.88 | balance | 117.5 | 2.5 | 47 | 3.41 | 73 | 22 |
| Comparative | 1 | 55.3* | 1.23 | balance | 44.2 | 0.9 | 49 | 1.64 | 39 | 12 |
| | 2 | 94.8* | 1.65 | balance | 58.1 | 1.8 | 32 | 1.22 | 41 | 12 |
| | 3 | 80.1 | 0.01* | balance | 56.9 | 1.2 | 47 | 0.94 | 33 | 10 |
| | 4 | 78.2 | 1.99* | balance | 37.7 | 2.0 | 19 | 0.82 | 45 | 14 |
| | 5 | 80.1 | 1.65 | Balance | 28.6* | 1.4 | 20 | 1.36 | 36 | 11 |
| | 6 | 77.8 | 1.25 | balance | 123.3* | 3.6 | 34 | 1.43 | 30 | 12 |
| | 7 | 80.2 | 1.54 | balance | 39.9 | 8.2 | 4.9* | 0.95 | 39 | 12 |
| | 8 | 82.1 | 1.77 | balance | 52.7 | 0.1 | 527* | 1.12 | 43 | 13 |
| Conventional | | 80.2 | 2.0* | balance | 36.1 | 0.9 | 40 | 0.42* | 42 | 12 |

(*denotes a value out of the range of the present invention.)

From the result shown in Table 1 and Table 2, it is found that the magnetic composite sheets made from the soft magnetic flaky powders 1 to 20 of the present invention have greater maximum values in the real number of the complex magnetic permeability for 30 kHz to 30 MHz and greater maximum values in the imaginary part of the complex magnetic permeability for 30 MHz to 3 GHz compared to the magnetic composite sheets made from the comparative soft magnetic flaky powders 1 to 8 and the magnetic composite sheets made from the conventional soft magnetic flaky powder.

EXAMPLE 2

The soft magnetic flaky powders 1 to 20 of the present invention shown in Table 1 and Table 2 produced in Example 1 were used as a raw material. They were respectively oxidized under the conditions shown in Table 3 and Table 4, to thereby form oxide layers having the thicknesses shown in Table 3 and Table 4 on the surface of the soft magnetic flaky powder of the present invention, to produce the soft magnetic flaky powders with oxide layer 1 to 20 of the present invention.

The soft magnetic flaky powders with oxide layer 1 to 20 of the present invention were mixed with chlorinated polyethylene at 15 percent by mass and kneaded, then roll-formed, to produce a magnetic composite sheet having a thickness of 0.5 mm in which the flat surface of the soft magnetic flaky powder with oxide layer was arranged in parallel with the sheet face. The specific resistance of this magnetic composite sheet was measured, and the results are shown in Table 3 and Table 4.

TABLE 3

| Type | | Raw material powder | Oxide layer forming condition: Atmosphere | Heating temperature (° C.) | Heating time (hrs) | Thickness of oxide layer (Å) | Specific resistance of magnetic composite sheet (Ω · cm) |
|---|---|---|---|---|---|---|---|
| Soft magnetic flaky powder with oxide layer of the present invention | 1 | Soft magnetic flaky powder 1 of Table 1 of the present invention | air | 400 | 0.5 | 1000 | $10^7$ |
| Soft magnetic flaky powder with oxide layer of the present invention | 2 | Soft magnetic flaky powder 2 of Table 1 of the present invention | air | 375 | 1 | 500 | $10^7$ |
| Soft magnetic flaky powder with oxide layer of the present invention | 3 | Soft magnetic flaky powder 3 of Table 1 of the present invention | air | 350 | 2 | 700 | $10^7$ |
| Soft magnetic flaky powder with oxide layer of the present invention | 4 | Soft magnetic flaky powder 4 of Table 1 of the present invention | air | 325 | 4 | 800 | $10^7$ |
| Soft magnetic flaky powder with oxide layer of the present invention | 5 | Soft magnetic flaky powder 5 of Table 1 of the present invention | air | 300 | 8 | 500 | $10^7$ |
| Soft magnetic flaky powder with oxide layer of the present invention | 6 | Soft magnetic flaky powder 6 of Table 1 of the present invention | $O_2$: 10% $N_2$: 90% | 400 | 0.5 | 600 | $10^6$ |
| Soft magnetic flaky powder with oxide layer of the present invention | 7 | Soft magnetic flaky powder 7 of Table 1 of the present invention | $O_2$: 10% $N_2$: 90% | 375 | 1 | 300 | $10^6$ |
| Soft magnetic flaky powder with oxide layer of the present invention | 8 | Soft magnetic flaky powder 8 of Table 1 of the present invention | $O_2$: 10% $N_2$: 90% | 350 | 2 | 400 | $10^6$ |
| Soft magnetic flaky powder with oxide layer of the present invention | 9 | Soft magnetic flaky powder 9 of Table 1 of the present invention | $O_2$: 10% $N_2$: 90% | 325 | 4 | 450 | $10^6$ |
| Soft magnetic flaky powder with oxide layer of the present invention | 10 | Soft magnetic flaky powder 10 of Table 1 of the present invention | $O_2$: 10% $N_2$: 90% | 300 | 8 | 300 | $10^6$ |

TABLE 4

| Type | | Raw material powder | Oxide layer forming condition: Atmosphere | Heating temperature (° C.) | Heating time (hrs) | Thickness of oxide layer (Å) | Specific resistance of magnetic composite sheet (Ω · cm) |
|---|---|---|---|---|---|---|---|
| Soft magnetic flaky powder with oxide layer of the present invention | 11 | Soft magnetic flaky powder 11 of Table 1 of the present invention | distilled water | 100 | 2 | 100 | $10^7$ |
| Soft magnetic flaky powder with oxide layer of the present invention | 12 | Soft magnetic flaky powder 12 of Table 1 of the present invention | distilled water | 100 | 1 | 80 | $10^7$ |
| Soft magnetic flaky powder with oxide layer of the present invention | 13 | Soft magnetic flaky powder 13 of Table 1 of the present invention | distilled water | 100 | 0.5 | 60 | $10^7$ |
| Soft magnetic flaky powder with oxide layer sent invention | 14 | Soft magnetic flaky powder 14 of Table 1 of the present invention | distilled water | 100 | 0.2 | 55 | $10^4$ |
| Soft magnetic flaky powder with oxide layer of the present invention | 15 | Soft magnetic flaky powder 15 of Table 1 of the present invention | distilled water | 100 | 0.1 | 50 | $10^3$ |
| Soft magnetic flaky powder with oxide layer of the present invention | 16 | Soft magnetic flaky powder 16 of Table 2 of the present invention | distilled water | 90 | 1 | 60 | $10^6$ |
| Soft magnetic flaky powder with oxide layer of the present invention | 17 | Soft magnetic flaky powder 17 of Table 2 of the present invention | distilled water | 80 | 2 | 60 | $10^6$ |
| Soft magnetic flaky powder with oxide layer of the present invention | 18 | Soft magnetic flaky powder 18 of Table 2 of the present invention | distilled water | 70 | 6 | 60 | $10^6$ |
| Soft magnetic flaky powder with oxide layer of the present invention | 19 | Soft magnetic flaky powder 19 of Table 2 of the present invention | distilled water | 60 | 24 | 60 | $10^6$ |
| Soft magnetic flaky powder with oxide layer of the present invention | 20 | Soft magnetic flaky powder 20 of Table 2 of the present invention | distilled water | 50 | 96 | 60 | $10^6$ |

From the result shown in Table 3 and Table 4, it is found that a high specific resistance is shown in the magnetic composite sheet made from the soft magnetic flaky powders with oxide layer 1 to 20 of the present invention formed with a thick oxide layer on the surface by oxidizing in an oxidizing atmosphere.

The invention claimed is:

1. An Fe—Ni—Mo soft magnetic flaky powder, having a component composition of, in percent by mass, Ni: 60 to 90%, Mo: 0.05 to 1.95%, and the balance of Fe and unavoidable impurities, with an average particle size of 30 to 120 μm, and each particle having a flat surface, and an aspect ratio (average particle size/average thickness) of 5 to 500; wherein a peak intensity ratio $I_{200}/I_{111}$ is within a range between 0.43 and 10, where $I_{200}$ is the peak height of the face index (200) and $I_{111}$ is the peak height of the face index (111), in an X-ray diffraction pattern measured in such a manner that the plane including the X-ray incident direction and the diffraction direction is perpendicular to the flat surface of said soft magnetic flaky powder, and the angle between the incident direction and the flat surface is equal to the angle between the diffraction direction and the flat surface.

2. A magnetic composite material wherein the Fe—Ni—Mo soft magnetic flaky powder of claim 1 is dispersed while the flat surface thereof is oriented in a resin.

3. A magnetic composite sheet wherein the magnetic composite material of claim 2 is a magnetic composite sheet, and the flat surface of said Fe—Ni—Mo soft magnetic flaky powder is oriented in the right angle direction with respect to the thickness direction of the magnetic composite sheet.

4. An Fe—Ni—Mo soft magnetic flaky powder with oxide layer wherein an oxide layer of a thickness of 50 to 1000 Å is formed on the surface of a soft magnetic flaky powder having a component composition of, in percent by mass, Ni: 60 to 90%, Mo: 0.05 to 1.95%, and the balance of Fe and unavoidable impurities, with an average particle size of 30 to 120 μm, each particle having a flat surface, and an aspect ratio (average particle size/average thickness) of 5 to 500; wherein a peak intensity $I_{200}/I_{111}$ is within a range between 0.43 and 10, where $I_{200}$ is the peak height of the face index (200) and $I_{111}$ is the peak height of the face index (111), in an X-ray diffraction pattern measured in such a manner that the plane including the X-ray incident direction and the diffraction direction is perpendicular to the flat surface of said soft magnetic flaky powder with oxide layer, and the angle between the incident direction and the flat surface is equal to the angle between the diffraction direction and the flat surface.

5. A magnetic composite material wherein the Fe—Ni—Mo soft magnetic flaky powder with oxide layer of claim 4 is dispersed while the flat surface thereof is oriented in a resin.

6. A magnetic composite sheet wherein the magnetic composite material of claim 5 is a magnetic composite sheet, and the flat surface of said Fe—Ni—Mo soft magnetic flaky powder with oxide layer is oriented in the right angle direction with respect to the thickness direction of the magnetic composite sheet.

* * * * *

UNITED STATES PATENT AND TRADEMARK OFFICE

CERTIFICATE OF CORRECTION

PATENT NO. : 7,575,645 B2
APPLICATION NO. : 10/567476
DATED : August 18, 2009
INVENTOR(S) : Igarashi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 373 days.

Signed and Sealed this

Fourteenth Day of December, 2010

David J. Kappos

David J. Kappos
*Director of the United States Patent and Trademark Office*